US006108982A

United States Patent [19]

Davison

[11] Patent Number: 6,108,982

[45] Date of Patent: Aug. 29, 2000

[54] FOLDING PLAY STRUCTURE

[76] Inventor: Julie McClendon Davison, P.O. Box 20248, Oklahoma City, Okla. 73156

[21] Appl. No.: 09/175,045

[22] Filed: Oct. 19, 1998

Related U.S. Application Data

[60] Provisional application No. 60/062,557, Oct. 21, 1997.

[51] Int. Cl.[7] ..... E04B 1/343; A63H 3/52

[52] U.S. Cl. ..... 52/64; 52/68; 52/69; 52/71; 52/745.14; 446/478; 446/488

[58] Field of Search ..... 52/64, 68, 69, 52/70, 71, 79.5, 745.11, 745.14; 446/478, 488; 119/165, 168

[56] References Cited

U.S. PATENT DOCUMENTS

| | | | |
|---|---|---|---|
| 109,166 | 11/1870 | Achenbach . | |
| D. 256,143 | 7/1980 | Birnkrant . | |
| D. 271,343 | 11/1983 | Miller . | |
| D. 306,264 | 2/1990 | Malmanger . | |
| D. 326,689 | 6/1992 | Farinelli, Jr. . | |
| D. 350,692 | 9/1994 | Seki . | |
| D. 380,021 | 6/1997 | Hartsfield . | |
| D. 381,705 | 7/1997 | Panthofer . | |
| D. 396,734 | 8/1998 | Koneke . | |
| 443,397 | 12/1890 | Mack . | |
| 577,416 | 2/1897 | Brown . | |
| 619,757 | 2/1899 | Johnstone et al. | 229/116.4 |
| 992,337 | 5/1911 | Butler . | |
| 1,092,321 | 4/1914 | Wiplitzhauser . | |
| 1,130,818 | 3/1915 | Herman . | |
| 1,517,030 | 11/1924 | Talcott . | |
| 1,756,526 | 4/1930 | Thompson . | |
| 1,881,356 | 10/1932 | Gold . | |
| 1,899,241 | 2/1933 | Marr . | |
| 1,917,629 | 7/1933 | Anderson . | |
| 1,918,375 | 7/1933 | Bowerstock et al. . | |
| 2,020,196 | 11/1935 | Mallgraf . | |
| 2,441,076 | 5/1948 | Makrianes . | |
| 3,231,942 | 2/1966 | O'Brien | 52/70 |
| 3,456,380 | 7/1969 | Cameron . | |
| 3,548,552 | 12/1970 | McBride . | |
| 3,752,349 | 8/1973 | Rana . | |
| 3,977,119 | 8/1976 | Nelson . | |
| 4,027,912 | 6/1977 | Pacca | 52/64 X |
| 4,067,137 | 1/1978 | Korthase . | |
| 4,085,762 | 4/1978 | O'Brian et al. . | |
| 4,112,635 | 9/1978 | Rylander . | |
| 4,122,638 | 10/1978 | O'Brian et al. . | |
| 4,132,345 | 1/1979 | Nielsen . | |
| 4,190,978 | 3/1980 | Nelson . | |
| 4,348,982 | 9/1982 | Selby . | |
| 4,391,223 | 7/1983 | Holland et al. . | |
| 4,467,572 | 8/1984 | Somers et al. . | |
| 4,504,497 | 3/1985 | Kurth et al. . | |
| 4,765,480 | 8/1988 | Malmanger . | |
| 4,792,082 | 12/1988 | Williamson . | |
| 4,793,507 | 12/1988 | Delplanque . | |
| 4,919,982 | 4/1990 | Hayes . | |
| 4,940,016 | 7/1990 | Heath . | |
| 4,964,249 | 10/1990 | Payne . | |
| 4,992,068 | 2/1991 | Conrad . | |
| 5,014,649 | 5/1991 | Taft . | |

(List continued on next page.)

FOREIGN PATENT DOCUMENTS

| | | | |
|---|---|---|---|
| 2363-261 | 4/1978 | France | 52/70 |

OTHER PUBLICATIONS

Pipsqueak Playhouse, Inc. See's Candies.

*Primary Examiner*—Carl D. Friedman
*Assistant Examiner*—Brian E. Glessner

[57] ABSTRACT

A collapsible, folding play structure including wall members which are integrally connected to each other and roof members which are integrally connected to the wall members. Two end roof members lend support to two side roof members which connect to end roof members with tabs. The two side roof members join at the top of the roof with interlocking tabs. The play structure may be folded and stored by folding the roof members outward to the corresponding wall members. The roof and wall members are then folded flat and again folded together to form a flat compact storage state for reuse.

21 Claims, 8 Drawing Sheets

U.S. PATENT DOCUMENTS 5,038,812 8/1991 Norman .
5,046,457 9/1991 Ashcroft et al. .
5,167,205 12/1992 Bell et al. .
5,184,436 2/1993 Sadler .
5,209,364 5/1993 LaPoint, Jr. et al. .
5,275,331 1/1994 Chung-Piao .
5,301,478 4/1994 Maese, Jr. .
5,301,705 4/1994 Zheng .
5,313,747 5/1994 Sakihara .
5,320,065 6/1994 Leopold .
5,323,922 6/1994 LaPoint, Jr. et al. .
5,328,048 7/1994 Stein .
5,337,700 8/1994 Toft .
5,345,961 9/1994 Yercha et al. .
5,423,709 6/1995 Summers .
5,465,686 11/1995 Monetti et al. .
5,467,794 11/1995 Zheng .
5,474,200 12/1995 Nicholson .
5,560,385 10/1996 Zheng .
5,582,135 12/1996 Bellows .
5,685,450 11/1997 Uda .
5,722,446 3/1998 Zheng .
5,752,470 5/1998 Koneke .
5,778,915 7/1998 Zheng .-

FOLDING PLAY STRUCTURE

CROSS-REFERENCES TO RELATED APPLICATIONS

This application claims the benefit of Provisional Patent Application Ser. No. 60/062,557 filed Oct. 21, 1997.

BACKGROUND OF THE INVENTION

This invention relates generally to play structures for children. More specifically, the invention relates to a collapsible play structure deployable from a flat, folded, stored configuration and is quickly erected and collapsed.

BACKGROUND—DESCRIPTION OF PRIOR ART

Structures With Complicated Features

Collapsible or foldable building structures for use by children have been known and popular for many decades. U.S. Pat. No. 4,467,572 to Somers et al. (1984) for example, describes a collapsible children's dwelling with a plurality of pieces hinged together. More recent, U.S. Pat. No. design 326,689 to Farinelli, Jr. (1992) illustrates a playhouse made of panels attached with a plurality of locking mechanisms. Both of these structures suffer from the disadvantage of having a plurality of pieces. Structures such as these are often complex and consequently expensive and complicated to manufacture. Another drawback is the complex assembly of the playhouses. U.S. Pat. No. 4,964,249 to Payne (1990) and U.S. Pat. No. 5,184,436 to Sadler (1993) describe other structures with similar disadvantages.

The playhouse described in U.S. Pat. No. 4,112,635 to Rylander (1978) is conveniently one-piece. However, Rylander's playhouse erects with complication. The included hinges increase cost and complexity of manufacturing. Other patents with complicated folding and expensive manufacturing include the play structures described in U.S. Pat. No. 4,027,912 to Pacca (1997), U.S. Pat. No. 992,337 to Butler (1911) and U.S. Pat. No. 5,423,709 to Summers (1995). Summers' doll house lacks the capacity to function as a playhouse considering the multiple levels.

BACKGROUND—DESCRIPTION OF PRIOR ART

Structures With Supplemental Scoring

Some structures are characterized by folding, lightweight, corrugated pieces such as the "Pipsqueak Playhouse" P.O. Box 56, Honesdale, Pa. 18431; and the See's Candies playhouse P.O. Box 93025, Long Beach, Calif. 90809, Item #1069. However, all of these playhouses use numerous supplemental scores to break down into smaller dimensions. The supplemental scoring causes these structures to be unstable and less sturdy. Such structures are often manufactured of very light material which also causes diminished strength.

Supplemental scores are often located in the middle of walls or panels to accommodate folding. These scores weaken the integrity of the walls and the strength and rigidity of an erected playhouse. Although simple to manufacture and to collapse, the three-piece playhouse illustrated in U.S. Pat. No. 1,918,375 to Bowerstock et al. (1933) possesses two walls made with supplemental scoring. Supplemental scoring is used in the walls of three-piece pet litter boxes disclosed in U.S. Pat. No. 5,337,700 to Toft (1994) and in U.S. Pat. No. 5,582,135 to Bellows (1996). U.S. Pat. No. 1,917,629 to Anderson (1933) describes a bath cabinet with a similar collapsing plan. Anderson's cabinet uses hinges which complicate manufacturing and add to expense. All of these structures, Bowerstock's, Tofts', Bellows', and Anderson's, also suffer from the previously stated disadvantages of multiple pieces.

Although one-piece, the play structures described in U.S. Pat. No. 1,517,030 to Talcott (1924) and U.S. Pat. No. 5,313,747 to Sakihara (1994) both possess the disadvantage of walls weakened by supplemental scoring. Both require hinges which create complicated and expensive manufacturing. Additionally, the three walls of Talcott's toy house provide a less realistic play area. U.S. Pat. No. 3,752,349 to Rana (1973), two embodiments of U.S. Pat. No. 4,122,638 to O'Brian et al. (1978), U.S. Pat. No. 4,793,507 to Delplanque (1988), and U.S. Pat. No. 5,752,470 to Koneke (1998) all describe structures requiring supplemental scores in the walls. All show structures which have flat roofs allowing less play and standing area for a child. U.S. Pat. No. 5,752,470 to Koneke (1998) in one embodiment illustrates a playhouse with a roof which peaks on one side. In addition to requiring supplemental scores in the walls, Koneke's roof allows for less standing room for the child. U.S. Pat. No. 5,014,649 to Taft (1991) describes a cat box which uses rectangular-shaped tabs to secure the roof. These tabs provide for simple assembly. However, not only do the walls of the box require supplemental scores, but also the roof's low pitch allows for less standing room inside. Furthermore, Taft's box requires an additional piece to secure the box in a folded state. The disadvantage of multiple pieces has been stated previously. U.S. Pat. No. 4,792,082 to Williamson (1988) also uses rectangular-shaped tabs. Folding of Williamson's litter box, however, requires supplemental scoring in the walls.

U.S. Pat. No. 3,977,119 (1976) and U.S. Pat. No. 4,190,978 (1980) both to Nelson describe playhouses which have roof panels which fold outward. These panels contribute to quick, easy folding. Supplemental scoring is used on the end walls, however, to allow collapse of the playhouse. Supplemental scoring on walls causes diminished strength and rigidity of the playhouse as previously stated. In addition, the use of half-sized roof panels lowers the pitch of the roof significantly therefore reducing the play area inside. Furthermore, the chimneys in Nelsons' playhouses cause the collapsed size of the playhouse to be quite large. Nelsons' playhouses therefore prove difficult to store.

The playhouse described in U.S. Pat. No. 3,231,942 to O'Brien (1966) also employs roof panels which fold outward. The full-sized roof provides more play room for children. However, supplemental scores in the walls cause the disadvantages previously stated. In addition, hinges are required to secure the roof and other parts of the playhouse. Hinges make manufacturing more expensive and complicated as previously stated. Although the playhouse is sturdy and self-supporting, it is difficult for a child to assemble. FR Patent 2363-261 to Picchi (1978) describes a greenhouse requiring supplemental scores in the walls and hinges, and it is difficult for a child to assemble. The low-pitched roof allows less play and standing area for a child.

BACKGROUND—DESCRIPTION OF PRIOR ART

Structures With Gable Roofs

Several one-piece structures for pets possess gable roofs which open at the top. These structures secure with rectangular-shaped tabs. For example, U.S. Pat. No. 5,465,686 to Monetti et al. (1995) discloses a pet house which uses rectangular-shaped tabs with ears to secure the roof. Improved simpler tabs are found in the litter containers disclosed in U.S. Pat. No. 4,940,016 to Heath (1990) and U.S. Pat. No. 5,167,205 to Bell et al. (1992). However, all three of these prior art patents fold into a bottom section, and walls are not integrally connected to each other which decreases the strength and rigidity of the structure. U.S. Pat. No. 4,132,345 to Nielsen (1979) and U.S. Pat. No. 5,046,457 to Ashcroft et al. (1991) describe containers which have A-shaped roofs opening at the top, but all fold to a blank. Unfolding to a blank rather than a folded state proves time-consuming. A large blank does not provide a small uniform package for storage or shipping unless it is folded and contained with another piece or component. This second folding and securing consumes more time and creates more expense. U.S. Pat. No. 5,275,331 to Chung-Piao (1994) describes a container with an A-shaped roof. Chung-Piao's container folds flat. However, a large container which folds in this manner forms a package that is large and is difficult to store. An embodiment of U.S. Pat. No. 4,348,982 to Selby (1982) describes a litter box which also has a similar roof, but Selby's box is not described as collapsible. Hence, Selby's litter box proves difficult to store.

BACKGROUND—DESCRIPTION OF PRIOR ART

Structures With Various Folding Procedures

U.S. design Pat. 256,143 to Birnkrant (1980) illustrates a collapsible toy building. This play building is simple and easy to collapse. However, the partial roof and partial walls create a less realistic play area. U.S. Pat. No. 3,456,380 to Cameron (1969) describes a house or barn which collapses into a book cover. The chimney forms a rectangular-shaped tab which is simple and easy to use. However, two walls are also joined by tabs creating a structure of less strength. U.S. Pat. No. 5,320,065 to Leopold (1994) describes a cat playhouse which folds in an accordion style. This playhouse lacks a roof which renders the playhouse less realistic for play.

BACKGROUND—DESCRIPTION OF PRIOR ART

Structures With Locking Lids

U.S. Pat. No. 4,765,480 to Malmanger (1988), U.S. Pat. No. 5,328,048 to Stein (1994), U.S. Pat. No. 5,474,200 to Nicholson (1995), U.S. design Pat. 271,343 to Miller (1983), and U.S. design Pat. 306,264 to Malmanger (1990) all illustrate non-collapsible containers. All have lid members which may swing, on opening of the container, to hang downward outside the container. The lids have locking integral tabs. The distinct disadvantage of these containers, however, is that they are not collapsible. Furthermore, without an entry, they are not functional as a playhouse for children.

BACKGROUND—DESCRIPTION OF PRIOR ART

Structures With Walls That Collapse Onto Each Other

In the first embodiment of U.S. Pat. No. 577,416 to Brown (1897), in U.S. Pat. No. 1,756,526 to Thompson (1930), U.S. Pat. No. 2,441,076 to Makrianes (1948), and U.S. Pat. No. 5,209,364 (1993) and U.S. Pat. No. 5,323,922 (1994) both to LaPoint, Jr. et al., the described walls of the structures collapse against each other and then fold together in a simple, rapid, efficient manner to form a compact package. However, all of these patents are composed of several pieces and have flat roofs. A structure with plural pieces suffers the possibility of loss of one or more of the pieces. Plural pieces may create more expense and require an additional manufacturing stage. As stated previously, a flat roof creates less play and standing area for a child. In addition, a separate roof lacks stability and can be bent and disfigured by a child if made of a lightweight material. The walls shown in U.S. Pat. No. 4,504,497 to Kurth et al (1985), U.S. Pat. No. 4,992,068 to Conrad (1991), and U.S. design Pat. 381,705 to Panthofer (1997) may collapse in the same manner, yet these also possess several pieces and have flat roofs. Similarly, the pet house illustrated in U.S. design Pat. 396,734 to Koneke (1998) may fold in the same manner, yet the roof is flat. The disadvantage of a flat roof has been previously stated. A one-piece structure described in U.S. Pat. No. 5,685,450 to Uda (1997) possesses similar folding walls, but it lacks a roof which renders the structure less realistic for child's play. U.S. Pat. No. 1,881,356 to Gold (1932) may fold in a like manner, but it lacks a roof. In addition, this playhouse's supplemental scoring weakens the integrity of the structure. Clips required for assembly render the house more costly and complex.

BACKGROUND—DESCRIPTION OF PRIOR ART

Structures Which Unfold To Blanks

U.S. Pat. No. 3,548,552 to McBride (1970) describes a playhouse with numerous supplemental scores which unfolds to a blank. McBride's playhouse involve s a complicated assembly. In addition, McBride's playhouse does not contain a roof As stated before, lack of a roof subtracts from the realism of the play structure. U.S. Pat. No. 5,301,478 to Maese, Jr. (1994) describes another playhouse with complicated folding which collapses to a blank. U.S. Pat. No. 1,130,818 to Herman (1915) describes a carton which erect s from a blank. Blanks prove difficult to store a s they are larger than a foldable unit. U.S. Pat. No. 4,391,223 to Holland et al. (1983) describes a pet house which unfolds to a blank. The blank can be folded together, one flap over the other, to form a shipping unit. However, the folded blank requires tying or an additional box to hold the unit together. An additional component adds expense and complicates the manufacturing of the pet house.

BACKGROUND—DESCRIPTION OF PRIOR ART

Structures Which Fold To Knockdown

Several one-piece playhouses knock down into a folded state. In the knockdown, one side wall and one end wall rest flat against the other side and end walls. This knockdown is quick and simple, and it lends itself to easy storage if the playhouse is of small design. If the playhouse is large, however, the knockdown state is cumbersome and requires a large storage space. For example, U.S. Pat. No. 619,757 to Johnstone and Lederer (1899) U.S. Pat. No. 1,899,241 to Marr (1933), one embodiment of U.S. Pat. No. 2,020,19 6 to Mallgraf (1935), and U.S. design Pat. 380,021 to Hartsfield (1997) all illustrate structures which can knock down into a folded state. The rectangular solid shape of these containers provides a narrow area for child's play; hence, the containers must be quite large to provide a space for one or more children to comfortably play inside. Additional supplemental score lines could have been used, but integrity and strength of the structure would have been sacrificed. A packaging container in U.S. design Pat. 350,692 to Seki (1994) illustrates a container which can knock down in a similar manner. This packaging container is not functional as a playhouse in that there is entry only through the roof.

BACKGROUND—DESCRIPTION OF PRIOR ART

A-shaped Structures And Tents

U.S. Pat. No. 5,345,961 to Yercha et al. (1994) describes an A-shaped toy tent. Yercha's toy tent is simple. However, multiple pieces of Yercha's tent create a risk of loss of pieces, especially by a child. In addition, Yercha's A-shape allows less play room inside the structure. Other A-shaped structures with this disadvantage are described in U.S. Pat. No. 109,166 to Achenbach (1870), U.S. Pat. No. 443,397 to Mack (1890), U.S. Pat. No. 1,092,321 to Wiplitzhauser (1914), U.S. Pat. No. 4,067,137 to Korthase (1978), and U.S. Pat. No. 4,085,762 to O'Brian et al. (1978). U.S. Pat. No. 4,919,982 to Hayes (1990) describes an A-shaped which is rotated to one side. Again, the A-shape of Hayes' spaceship allows for less play room. The first embodiment of U.S. Pat. 5,778,915 to Zheng (1998) describes an A-shaped tent which is one-piece and collapses into a small package, yet the shape again allows for less play area. Tents of various shapes are described in other embodiments of U.S. Pat. No. 5,778,915 to Zheng (1998), in U.S. Pat. 5,038,812 to Norman (1991), and U.S. Pat. No. 5,301,705 (1994), U.S. Pat. No. 5,467,794 (1995), U.S. Pat. No. 5,560,385 (1996), and U.S. Pat. No. 5,722,446 (1998) all to Zheng. All of these one-piece tents have walls which fold against each other and then together in a simple, quick manner. However, the tents collapse further into a small package by twisting and folding. This twisting and folding is difficult for a small child. In addition, Zheng's and Norman's tents are unlikely to be manufactured with rigid materials.

BACKGROUND—DESCRIPTION OF PRIOR ART

Disadvantages

All of the play structures or similar structures which could be utilized as play structures suffer from one or more of a number of disadvantages:

(a) Structures with multiple pieces can be extremely complex and consequently expensive and complicated to manufacture. Multiple pieces can be misplaced or lost.

(b) Structures which include added components such as hinges or clips can be complicated to erect and collapse. They are more expensive and complicated to manufacture.

(c) A separate roof lacks stability as it can be bent and disfigured easily by a child. A disfigured roof causes complication in assembling the play structure.

(d) Play structures lacking walls and/or a roof provide for less realistic play.

(e) A flat roof restricts possible play area and standing room for the child. In addition, a flat roof manufactured of lightweight material can be unstable and easy for a child to crease or bend.

(f) Both roofs that peak on an end and half roofs provide less play area and standing room.

(g) Structures with walls that are not integrally connected are less sturdy and rigid.

(h) Some one-piece structures have a complicated, inefficient erecting and/or collapsing stage. A tent which folds down into a small unit requires a sequence of folding and twisting which may be difficult for a child.

(i) Structures with roof pieces that protrude after knockdown are large when collapsed and therefore difficult to store.

(j) An A-shaped structure provides less room for play. Similarly, a rectangular play structure provides a smaller, narrower play space unless the rectangle is extremely large. Furthermore, if the rectangle is large, the knockdown state of the play structure is large and cumbersome for storage.

(k) Supplemental scores diminish wall or roof strength and overall integrity of the play structure reducing its life span.

(l) A play structure which unfolds to a blank can be difficult to store.

(m) A play structure which unfolds to a blank may require additional folding and an additional piece or component to secure the folded blank.

(n) A tent which twists and folds to a small package most likely cannot be made of stiff materials.

(o) Many prior art structures cannot be made of light material and so are difficult to transport.

(p) Structures which do not collapse are extremely difficult to store.

Objects and Advantages

Accordingly, several objects and advantages of my present invention are:

(a) to provide a one-piece play structure which is simple, inexpensive, and easy to manufacture formed of a continuous piece of material, and to provide one that is simple for a child to maintain;

(b) to provide a play structure which requires a minimum of supplemental components;

(c) to provide a play structure with an integral roof system;

(d) to provide a play structure which encloses walls and includes a roof for more realistic child play;

(e) to provide a play structure with roof members that allow a full-sized roof to offer more play area and standing room for a child and that allow for a rigid, stationary play structure;

(f) to provide a play structure with a roof peaked in the middle to allow for more play area and standing room for a child and where the shape of the roof complements the pitch of the roof;

(g) to provide a play structure with integrally connected walls for increased strength and rigidity;

(h) to provide a play structure which is quickly erected and collapsed for storage purposes and which is simple enough for a child to erect and collapse;

(i) to provide a play structure which is formed to collapse without relinquishing any strength to allow a smaller, uniform collapsed unit simple to store;

(j) to provide a play structure with walls which are approximately proportional and which generally form the symmetric shape of a square to provide a large, wide enclosed interior space yet a compact, simple collapse; to provide a play structure with wall panels that have four sides and roof panels that have two or more sides with roof panels symmetric to the opposing panel.

(k) to provide a play structure with minimal scoring so that maximum strength and integrity of the play structure are upheld; fold lines are limited to those connecting or joining the wall members;

(l) to provide a play structure with a folded orientation rather than simply a blank stage to allow for simple, compact storage;

(m) to provide a play structure with simple collapsing sequence which when completed forms a self-contained package;

(n) to provide a play structure which can be manufactured of many different materials;

(o) to provide a play structure which may be manufactured of a lightweight material so that it is easy to transport; and (p) to provide a play structure which is collapsible and therefore easy to store.

Other objects and advantages are to provide a play structure which has interlocking tabs and protruding tabs with a mating slot which prove efficient and easily releasable and lockable in both the folded and unfolded orientation; which is a flat, folded configuration and is easily shipped; which is inexpensive and may be enjoyed by a broad range of children regardless of economic status because of its economical construction and ease of shipping in-the-flat; which can be shipped to the purchaser and requires no assembly; which can be used as an art project or educational project in decorating the exterior and/or interior; which can be printed with artwork which complements the design of the play structure; which can be used with other embodiments of the play structure to create a neighborhood, town, etc.; which when assembled is large enough for several children and/or an adult to play in; which when folded is reduced in size enough to slide under a sofa, in a closet, under a bed, etc.; and which may take a variety of external shapes.

Further objects and advantages of my invention will become apparent from a consideration of the drawings and ensuing description.

SUMMARY

In accordance with the present invention a folding play structure comprises four integrally connected parts which hold up the structure and form an enclosure and four attached parts, integrally connected to the first four parts, respectively, which hold the structure together and form a top to the enclosure. When collapsing, the parts which hold the structure together fold down upon the parts which hold up the structure which allows the entire structure to collapse together and then to fold in half.

DRAWING FIGURES

In the drawings, closely related figures have the same number but different alphabetic suffixes.

Figure 1:
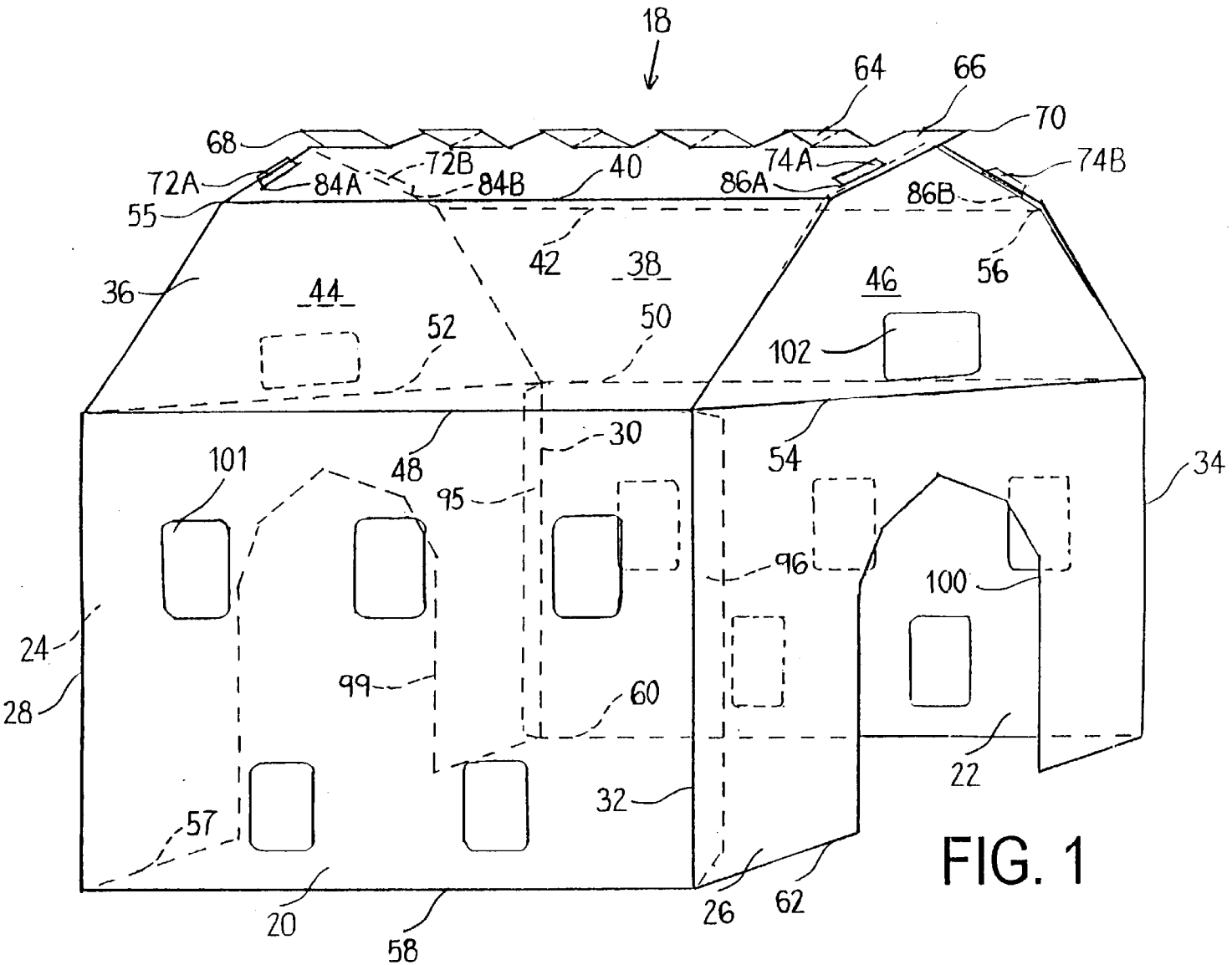
FIG. 1 shows a front left perspective view of one embodiment of the folding play structure showing my new design in an open or erect position.

| REFERENCE NUMERALS IN DRAWINGS | |
|---|---|
| 18 | play structure |
| 20 | side panel |
| 22 | side panel |
| 24 | end panel |
| 26 | end panel |
| 28 | vertical fold line |
| 30 | vertical fold line |
| 32 | vertical fold line |
| 34 | vertical fold line |
| 36 | side roof panel |
| 38 | side roof panel |
| 40 | upper horizontal fold line |
| 42 | upper horizontal fold line |
| 44 | end roof panel |
| 46 | end roof panel |
| 48 | lower horizontal fold line |
| 50 | lower horizontal fold line |
| 52 | lower horizontal fold line |
| 54 | lower horizontal fold line |
| 55 | end roof panel midpoint |
| 56 | end roof panel midpoint |
| 57 | lower margin |
| 58 | lower margin |
| 60 | lower margin |
| 62 | lower margin |
| 64 | integral tabs |
| 66 | integral tabs |
| 68 | upper margin |
| 70 | upper margin |
| 72A | rectangular-shaped tab |
| 72B | rectangular-shaped tab |
| 74A | rectangular-shaped tab |
| 74B | rectangular-shaped tab |
| 84A | mating slot |
| 84B | mating slot |
| 86A | mating slot |
| 86B | mating slot |
| 95 | joint |
| 96 | joint |
| 99 | doorway |
| 100 | doorway |
| 101 | window |
| 102 | window |
| 104 | second play structure |
| 106 | unbending side roof panel |
| 107 | mail slot |
| 108 | skylight |
| 110 | door |
| 112 | peephole |
| 114 | finger hole |
| 116 | end roof panel |
| 118 | decorative windows |
| 122 | third play structure |
| 124 | pointed top doorways |
| 126 | circular windows |
| 128 | end roof panel |
| 130 | Y-shaped windows |
| 132 | fourth play structure |
| 134 | peep flap |
| 136 | rounded top doorways |
| 138 | folded play structure |

DESCRIPTION—FIGS. 1 TO 4,6

One embodiment of the folding play structure of the present invention is illustrated FIG. 1 (front left view). It resembles a barn. Play structure 18 has a pair of opposable rectangular-shaped side panels or walls 20 and 22 and a pair of opposable rectanglarly-shaped single, rigid end panels or walls 24 and 26. Side panels 20 and 22 and end panels 24 and 26 are attached to each other along vertical fold lines, crease lines, or scores 28, 30, 32, and 34. Vertical fold lines 28, 30, 32, and 34 are hingedly generally equal in length and parallel to each other. Vertical fold lines 28, 30, 32, and 34 may be numbered one as shown or as multiple parallel scores to allow for ease in folding the structure and lack of binding of the material. A roof or top of the play structure 18 in the shape of a gambrel roof is formed of a pair of opposable rectangularly-shaped side roof panels 36 and 38 and a pair of 5-sided or pentagon-shaped end roof panels 44 and 46. Side roof panels 36 and 38 include intermediate upper horizontal fold lines 40 and 42 to allow bending in side roof panels 36 and 38. Side roof panels 36 and 38 are attached to the side panels 20 and 22 at lower horizontal fold lines 48 and 50. End roof panels 44 and 46 are attached to end panels 24 and 26 at lower horizontal fold lines 52 and 54. The distance between upper horizontal fold lines 40 and 42 and lower horizontal fold lines 48 and 50 is generally the same distance between end roof panel midpoints 55 and 56 and lower horizontal fold lines 52 and 54. Although side panels 20 and 22, end panels 24 and 26, and side roof panels 36 and 38 are described as rectangular, other shapes may be used. Similarly, although end roof panels 44 and 46 are described as pentagons, other shapes may be used. Side panels 20 and 22 are opposable or generally identical to each other as are end panels 24 and 26, side roof panels 36 and 38, and end roof panels 44 and 46. In addition, side panels 20 and 22, end panels 24 and 26, and side roof panels 36 and 38 are proportional or generally the same size allowing end panels and side panels to be interchangeable. Lower margins 57, 58, 60, and 62 are generally parallel to upper horizontal fold lines 40 and 42 and to lower horizontal fold lines 48, 50, 52, and 54, and all are generally equal in length. Lower margins 57, 58, 60, and 62 rest directly atop a horizontal support surface such as the ground or a floor so that the bottom of play structure 18 is open. However, an attached floor may be included. Side panels 20 and 22 end panels 24 and 26 together form a square-shaped area.

Side roof panels 36 and 38 are made generally identical to each other in the die-cutting process with a set of five integral or interlocking tabs 64 and 66 along upper margins 68 and 70. Upper margins 68 and 70 are generally parallel and equal in length to lower horizontal fold lines 48, 50, 52, and 54. When such side roof panels 36 and 38 are assembled, they will oppose one another, and engaged integral tabs 64 and 66 complete an interlocking configuration that forms a sound and complete closure or roof. Integral tabs 64 and 66 are illustrated as rectangular with tapered, angled, short sides. The taper allows integral tabs 64 and 66, when initially engaged, to slide together easily. Integral tabs 64 and 66 then wedge together at the base. Integral tabs 64 and 66 may be numbered more or less than five, and they may be made in various shapes including rectangular with angled short sides as illustrated, rectangular with straight short sides, rounded triangular, small lock tab base, friction base, etc. End roof panels 44 and 46 include rectangular-shaped locking tabs or notches 72A, 72B, 74A and 74B intermediately along the outer edges of each panel. Rectangular-shaped tabs 72A, 72B, 74A, and 74B may also be of "T," hook, or various other shapes. These rectangular-shaped tabs 72A, 72B, 74A, and 74B engage into mating slots 84A, 84B, 86A, and 86B located intermediately on the outer edges of side roof panels 36 and 38. When integral tabs 64 and 66 along with the rectangular-shaped tabs 72A, 72B, 74A, and 74B and mating slots 84A, 84B, 86A, and 86B are engaged, play structure 18 is completely self-supporting aided by material forming it such as corrugated paper. Play structure 18 can be made or formed from one sheet of corrugated paper with one glued, taped, or stapled seam or manufacturer's joint or from two sheets with two joints 95 and 96. Joint 95 on side panel 22 is adhered to end panel 24, and joint 96 on side panel 20 is adhered to end panel 26. Joints 95 and 96 may be placed on panels other than those illustrated. Although play structure 18 is described as being formed of corrugated paper, other materials such as corrugated plastic, various laminated fibrous materials, etc. may be used. Play structure 18 should be made of a foldable, stiff material preferably lightweight to facilitate ease of transportation.

Play structure 18 is provided with doorways 99 and 100 preferably located on end panels 24 and 26. In the preferred embodiment, doorways 99 and 100 are large enough for a child or small adult to enter and exit. Play structure 18 is also provided with windows 101 and 102 which provide ventilation and light. Windows 101 and 102 are shown on side panels 20 and 22 and end roof panels 44 and 46; however, they may be placed in various panels or areas and may be numbered more or less than illustrated. Although windows 101 and 102 are illustrated as rectangular in shape and doorways 99 and 100 as 6-sided in the shape of a pentagon placed on top of a square, both may be formed of various shapes. In addition, doorways 99 and 100 and windows 101 and 102 are illustrated as having no opening and closing features; yet, opening and closing doors, windows, gates, peepholes, skylights, etc. may be used or included.

Figure 2:
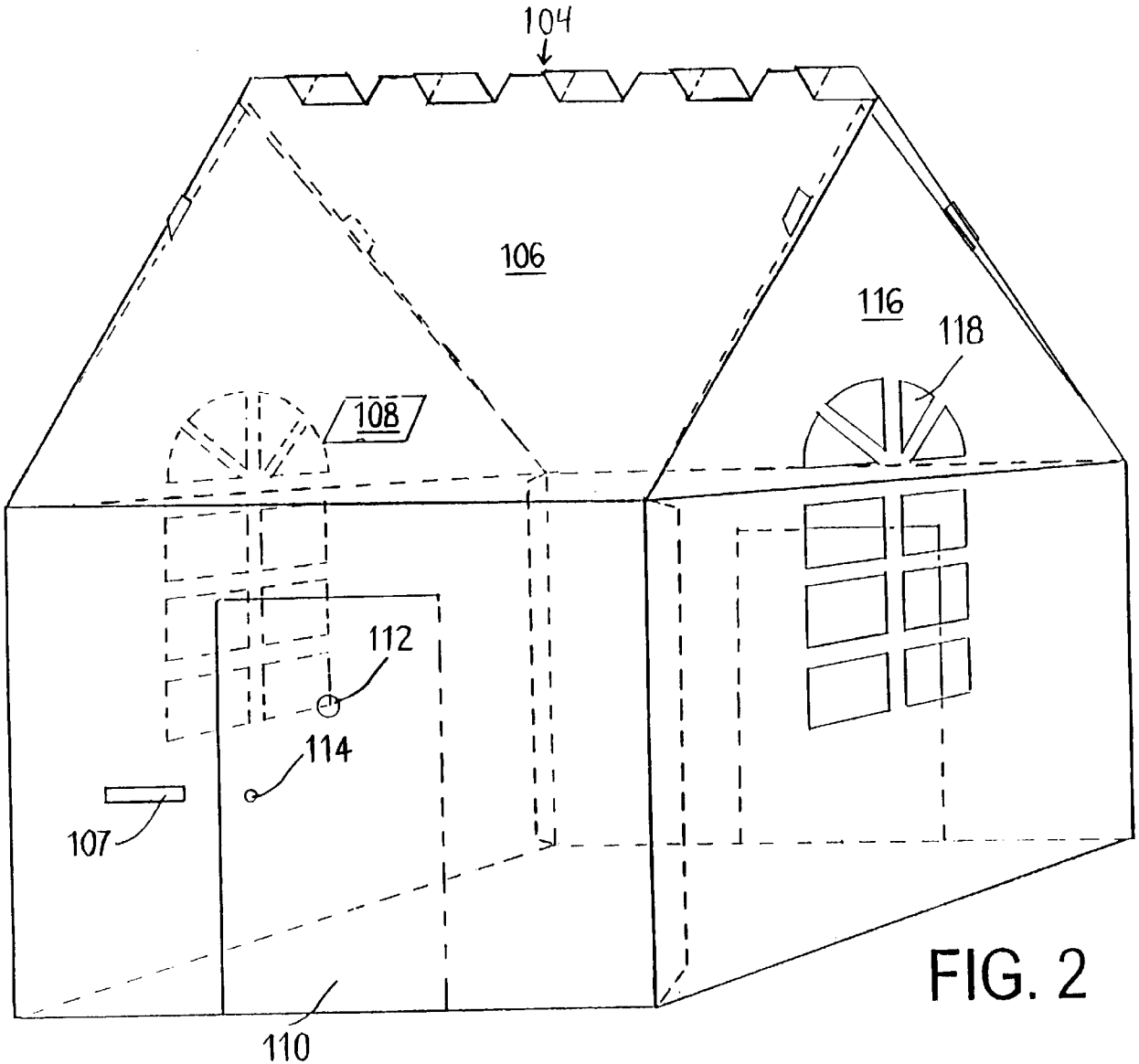
FIG. 2 is a second embodiment (front left view) of the folding play structure in an open or erect position.

FIG. 2 (front left view) illustrates a second embodiment 104 of the play structure of the present invention where a second play structure 104 is provided with straight or unbending side roof panels 106. These unbending roof panels 106 of FIG. 2 lack horizontal fold lines 40 and 42 shown in the embodiment in FIG. 1. Second play structure 104 resembles a house or cottage rather than a barn as in FIG. 1. Included are a mail slot 107, opening and closing windows, peep flaps, or skylights 108 and doors 110. Windows 108 may be placed in any panel, and doors 110 may be placed in any side or end panel. Doors 110 include a peephole 112 and a finger hole or door knob 114 for ease in opening and closing. End roof panels 116 are triangular in shape and include a decorative window or vent design 118.

Figure 3:
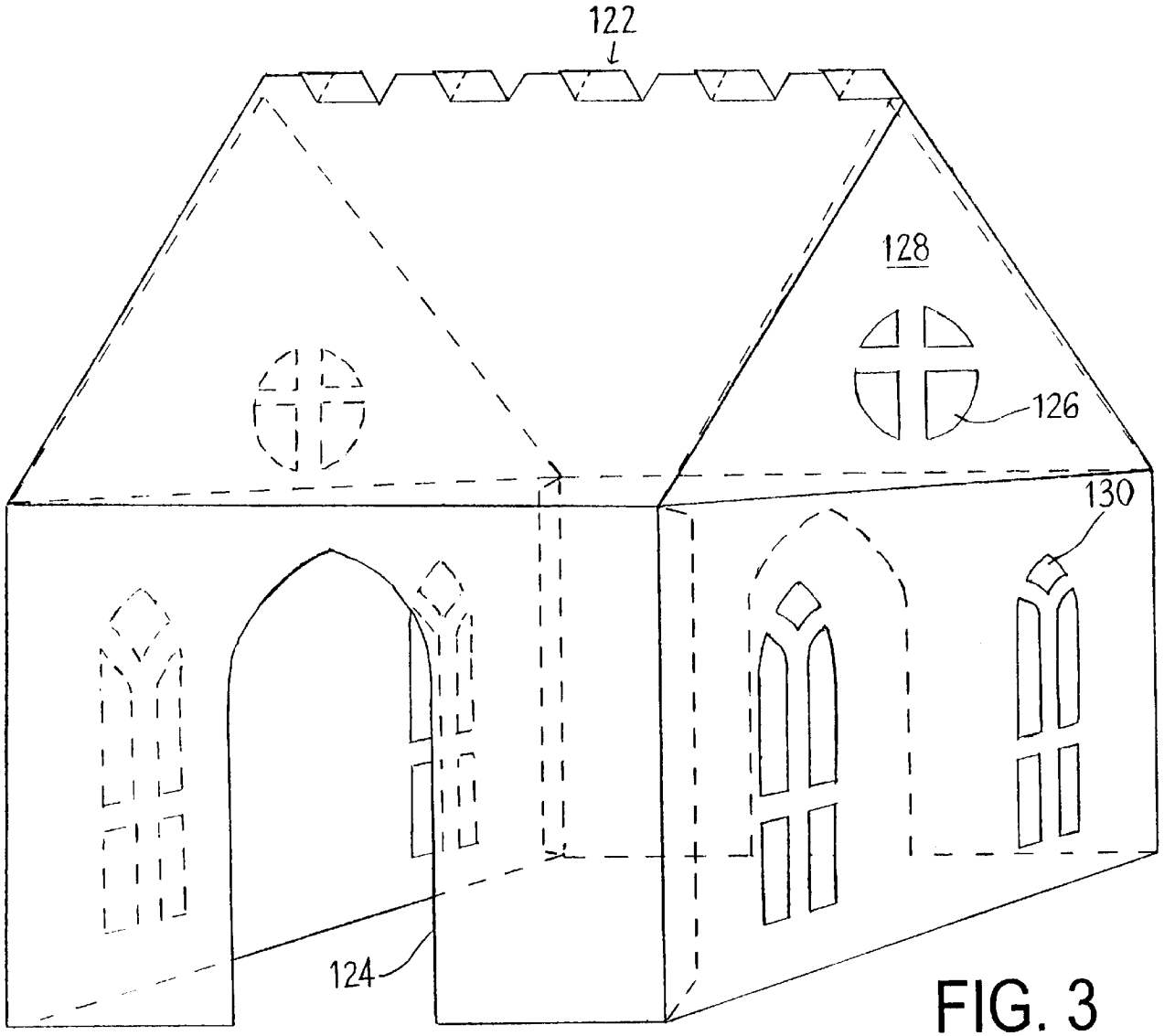
FIG. 3 is a third embodiment (front left view) of the folding play structure in an open or erect position.

FIG. 3 (front left view) illustrates a third embodiment of the play structure. FIG. 3 resembles a church including doorways which curve up and inward to a point at the top 124. FIG. 3 is similar in structure to FIG. 2. Circular windows with a cross pattern inside 126 are located on end roof panels 128. Long windows with "Y" patterns inside 130 are included. Windows and doors may be placed in other panels and may be of altered shapes.

Figure 4:
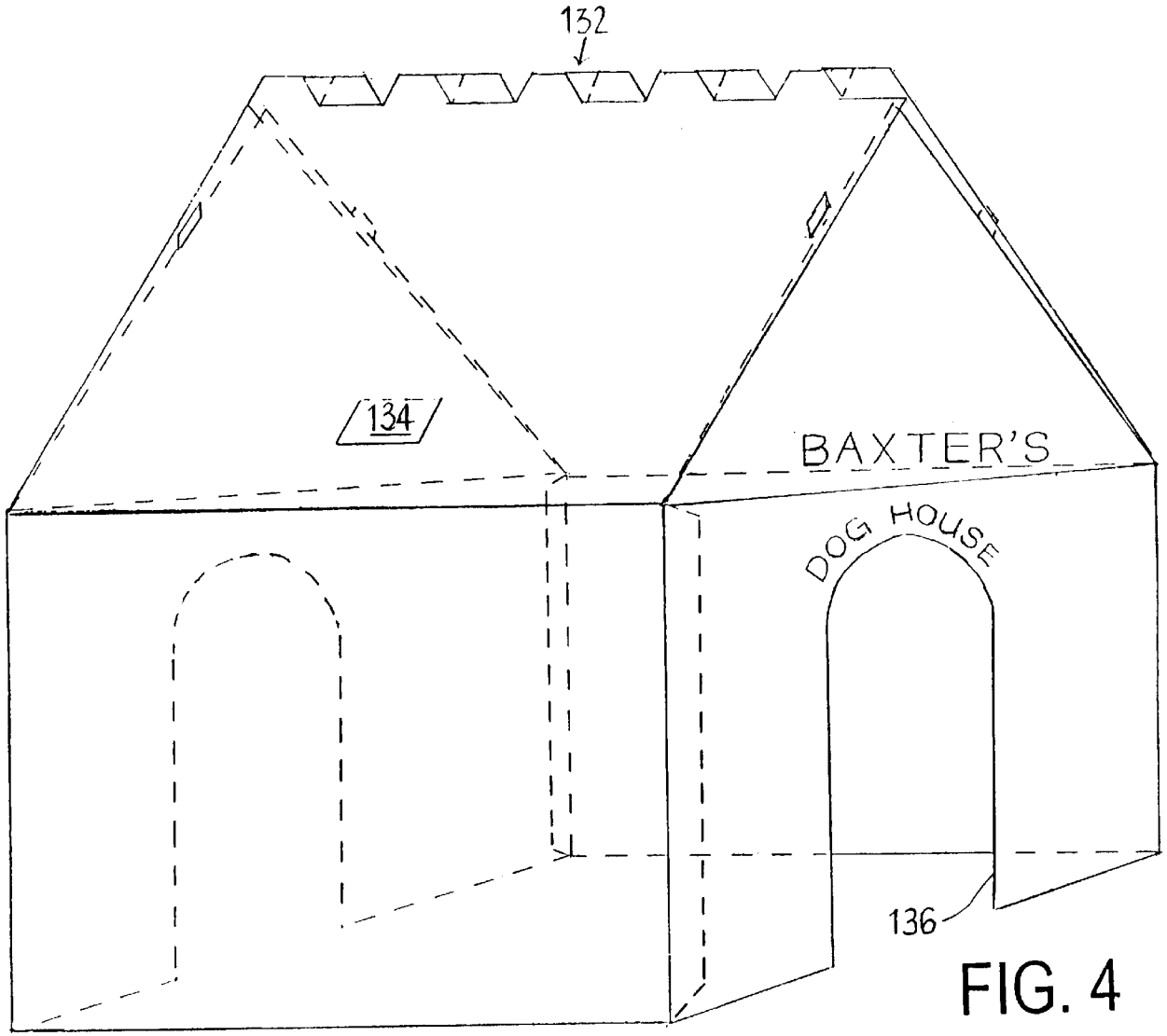
FIG. 4 is a fourth embodiment (front left view) of the folding play structure in an open or erect position.

FIG. 4 (front left view) shows a fourth embodiment 132 resembling a dog house. The structure is similar to FIG.'s 2 and 3. Windows, skylights, or peep flaps 134 are included along with rounded top doorways 136. Peep flaps and doors may be located in any panel and may be constructed of alternate shapes.

Figure 6:
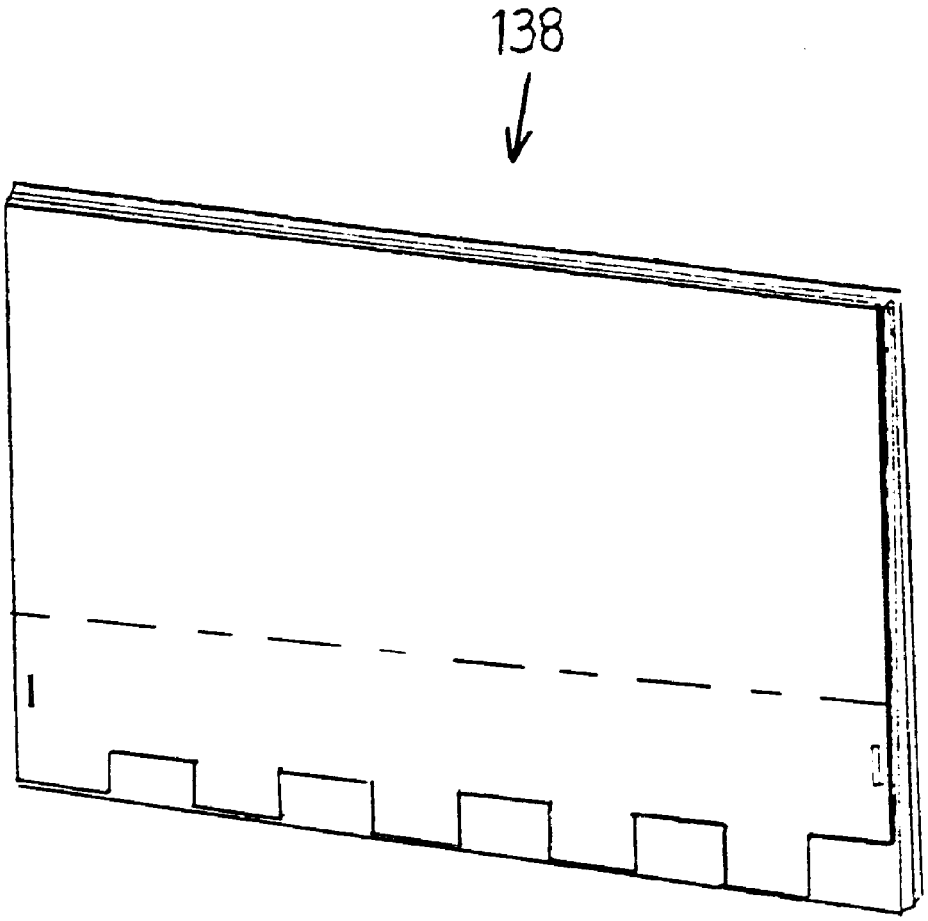
FIG. 6 is a front left perspective view of the folded or closed folding play structure of FIG. 1.

Illustrated in FIG. 6 (front left view), the play structure in the folded position 138 is a one-piece, lightweight, compact rectangular solid. Folded play structure 138 may be easily stored behind a door or under a sofa, etc.

The play structure of the present invention may take a variety of external shapes including but not limited to the described embodiments. These external shapes are facilitated by the provision of different shapes to form the desired outcome. The play structure may be of any size but is commonly of such a size as to accommodate one or more persons.

From the description above, a number of advantages of my play structure become evident:

1) The play structure may be manufactured relatively simply; for example, one or two corrugated sheets could be run through a die-cutting machine and then the sheet or sheets are glued, taped, or stapled;
2) The play structure is quickly and easily assembled and disassembled;
3) Once the sheet or sheets are joined, the play structure is a one-piece toy thus avoiding the need to keep up with additional parts;
4) When assembled, the play structure is large enough for several children and/or an adult to play in; yet, when folded the initial size of the structure is greatly reduced so that it could slide under a sofa or store against a closet wall or behind a door, etc.;
5) The play structure can be printed with a complementary design or left "plain" for decorating as an art and learning project for children; and
6) The play structure may take a variety of external shapes.

Now the subject of this patent application may be more generally described as follows: The folding play structure is made up of approximately four parts which hold up the structure and form an enclosure and approximately four attached parts which hold the structure together and form a top to the enclosure. When collapsing, the parts which hold the structure together fold down upon the parts which hold up the structure which allows the entire structure to collapse and to fold in half.

Operation—FIGS. 5A TO 5F, 6

Figure 5A:
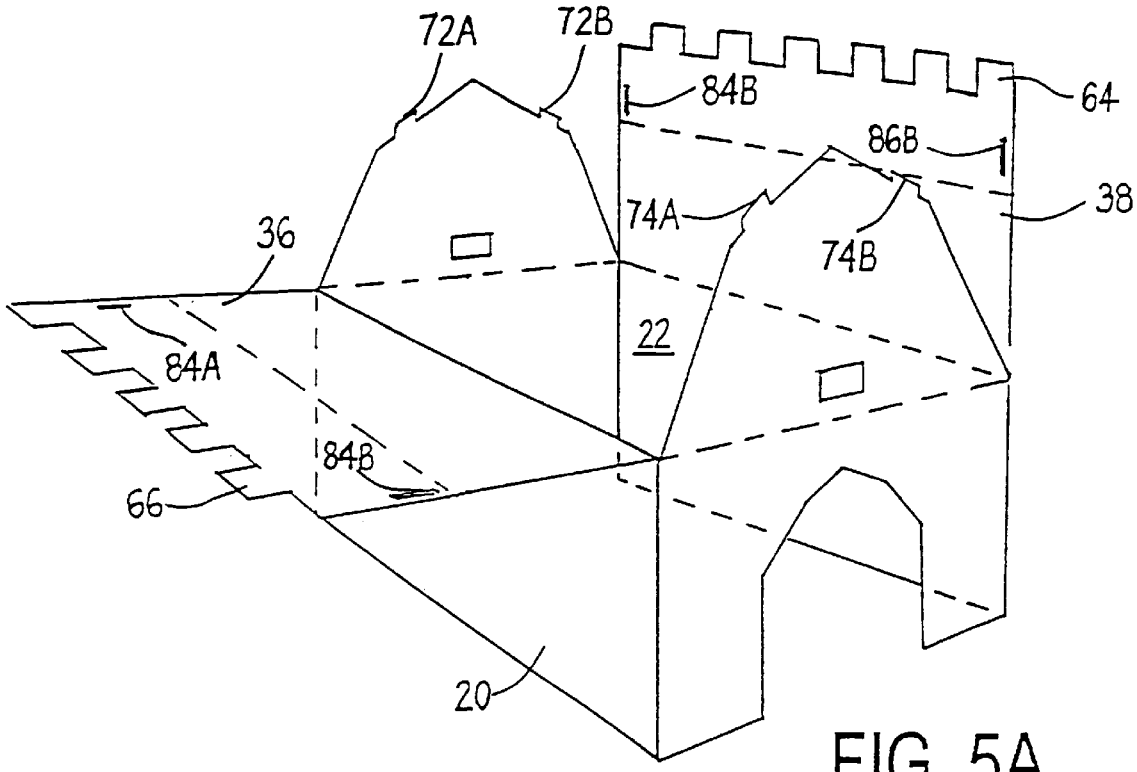
FIGS. 5A through 5F (front left views) illustrate the operation of the folding play structure of FIG. 1 showing how it may be folded up for compact storage.
Figure 5B:
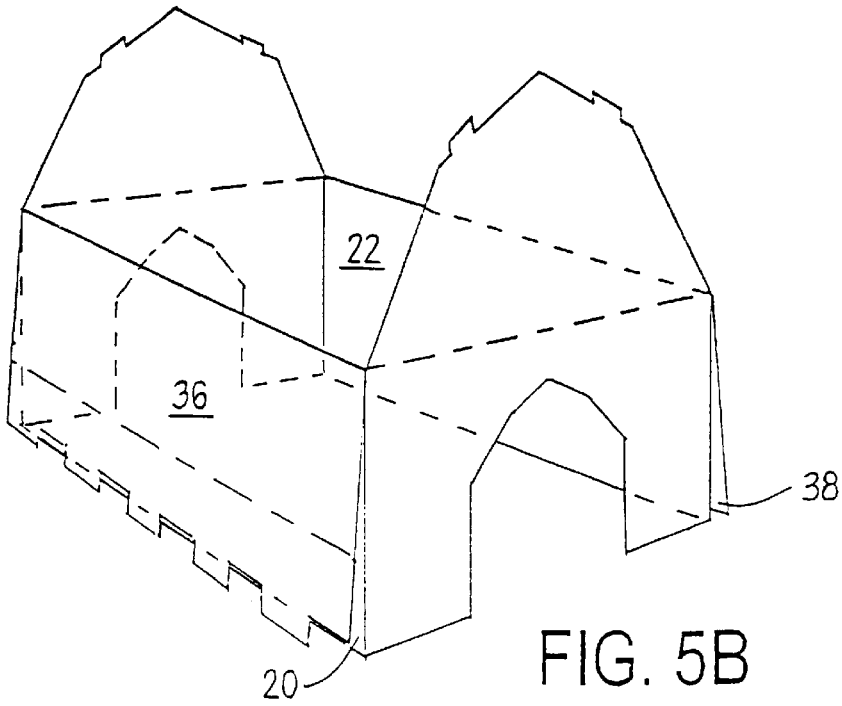
Figure 5C:
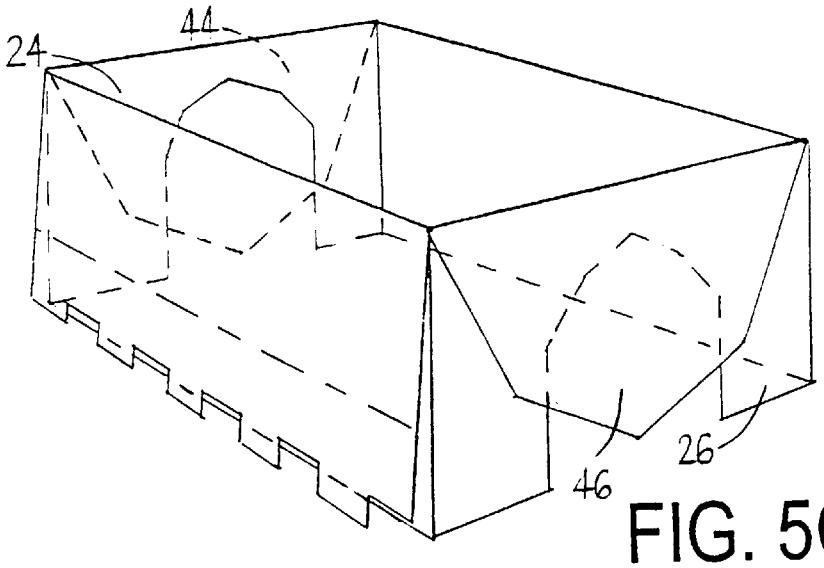
Figure 5D:
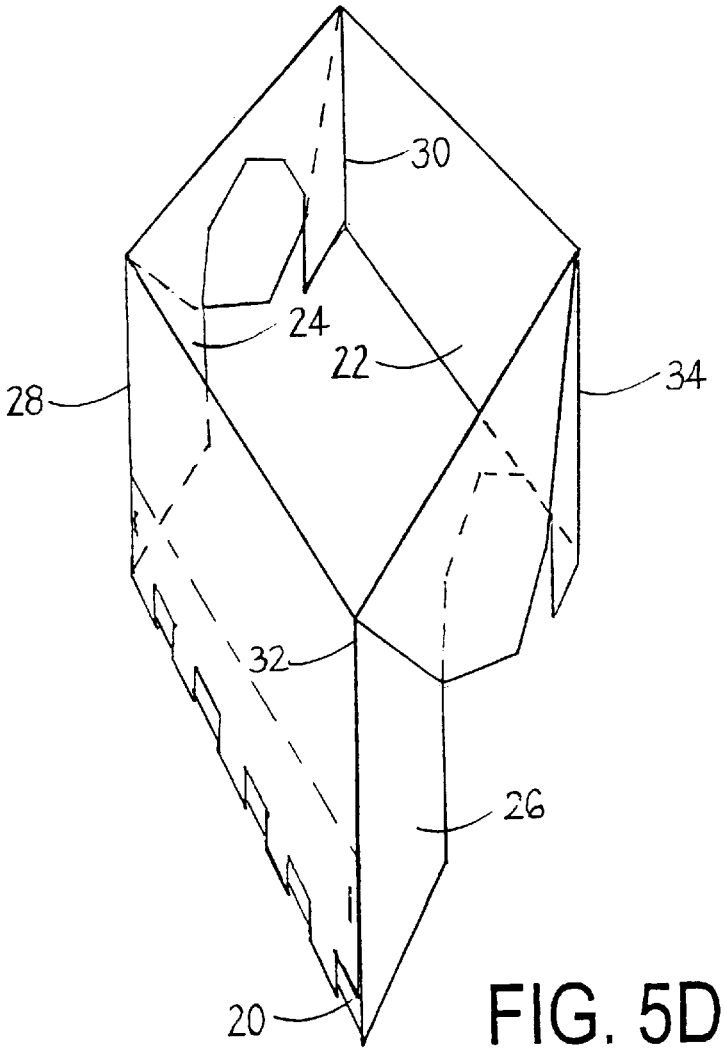
Figure 5E:
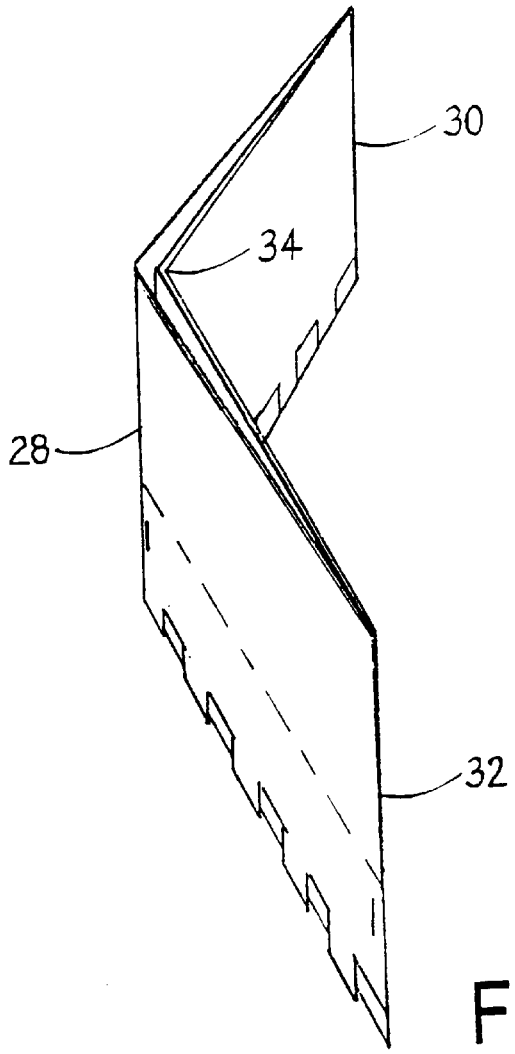
Figure 5F:
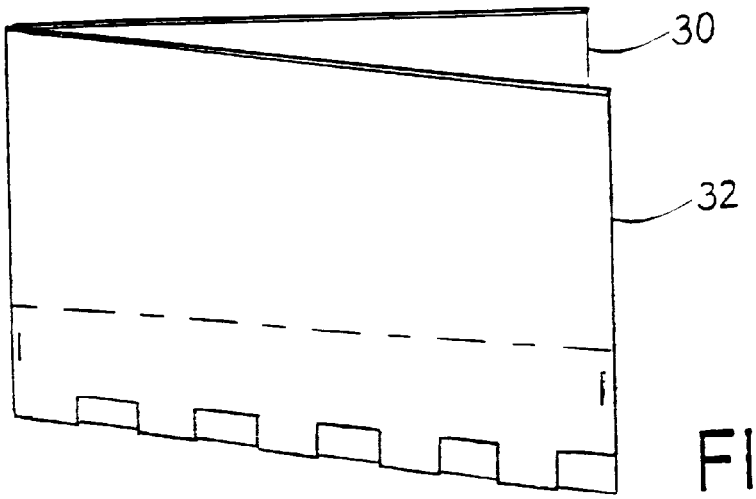

FIGS. 5A through 5F illustrate the various steps for folding the play structure so that it may be stored. In FIG. 5A (front left view), the first step consists of folding either of side roof panels 36 down so that it is collapsed upon corresponding side panel 20. Integral tabs 64 and 66 along with rectangular-shaped tabs 72A and 74A and mating slots 84A and 84B easily disengage by pulling side roof panel 36 away from its assembled position. Similarly, the other side roof panel 38 is folded down against side panel 22 disengaging rectangular-shaped tabs 72B and 74B from mating slots 84B and 86B. In FIG. 5B (front left view), side roof panels 36 and 38 rest against side panels 20 and 22, respectively. In FIG. 5C (front left view), end roof panels 44 and 46 subsequently collapse to rest against end panels 24 and 26, respectively. As shown in FIG. 5D (front left view), side panel 20 can then be collapsed against end panel 26, and end panel 24 against side panel 22, by continuing to fold at vertical fold lines 30 and 32 thereby bringing vertical fold lines 28 and 34 completely together or contiguous so that the adjacent side panel 20 and end panel 26 are co-planar and the adjacent end panel 24 and side panel 22 are co-planar. The next step is illustrated in FIGS. 5E (front left view) and 5F (front left view) showing that vertical lines 28 and 34 are now together, and the play structure is now folded in half by bringing vertical fold lines 30 and 32 together. The structure is folded into a complete storage configuration, a single stack of side panels 20 and 22, end panels 24 and 26, side roof panels 36 and 38, and end roof panels 44 and 46, and the collapsed size is a fraction of the size of the initial structure at approximately the size of one side panel 20. FIG. 6 shows the collapsed play structure ready for storage.

Conclusions, Ramifications, And Scope

Accordingly, the reader will see that the collapsible play structure of this invention is collapsible, simple, and relatively inexpensive and easy to manufacture. The play structure is easy for a child to maintain and erect and collapse quickly with little or no help. It can be stored in a convenient area such as under a couch, bed, or in a closet. Furthermore, the design of the play structure has the additional advantages that it provides a large play area for a child with enclosed walls and roof for more realistic play;

it provides walls and roof which are integrally connected which keeps the erected play structure strong and rigid for child's play;

it permits folding in a manner that uses existing scores which keeps the erected play structure strong and rigid for child's play; and it permits manufacturing using many different materials.

Although the description above contains many specificities, these should not be construed as limiting the scope of the invention but as merely providing illustrations of some of the presently preferred embodiments of this invention. Many other variations are possible. For example, the play structure can be manufactured of other materials such as corrugated plastic, wood, and tent or kite material. If materials used make scoring impractical, all scored areas can be cut through and hinged instead so the play structure can be folded flat for easy storage. The play structure can be coated to make it water-resistant. The play structure can be modified in dimensions of length, width, and depth to accommodate a desired size. The basic principles of my play structure depend on the proportions of length and width bring nearly equal; yet, the depth or height are adjustable independently. The preferred embodiment has roof sections equal to the depth of the walls allowing a maximum dimension to the roof ridge; however, the roof sections can be of other sizes. With or without an adjustment in size, the play structure has other uses such as a greeting card, an animal shelter, a portable building, a litter box, a doll house, a bean bag animal house, a bed cover or tent, a model car shop or garage, a shipping or wrapping package, a toy storage box, and a cover for household items such as a computer or litter box. The play structure can have other embodiments such as other houses, a church, a school, an animal shelter, a castle, a cabin, a spaceship, a theater, a tent, a restaurant, a store, a museum, a building under construction, an office building, a doctor's office, a dentist's office, a hospital, a fire station, a police station, a post office, a library, a greenhouse, a garage, a shed, a boat, an automobile, and a submarine. Various accessories can be added on or in the play structure such as a chimney, a mailbox or slot, simulated stain glass windows, curtains, doorknobs, pulleys, a book drop, etc. The play structure can be covered in a white or colored paper, and it can have various printing.

Thus the scope of the invention should be determined by the appended claims and their legal equivalents rather than by the examples given.

What is claimed is:

1. A collapsible play structure comprising:

(a) a plurality of wall members each having an erect and a collapsed orientation, each wall member approximately equal in size comprising four sides;

wherein said wall members are each a single rigid wall panel;

wherein the four sides of each wall member comprise a first side, a second side, a third side, and a fourth side, the first and third sides being equal in length, and the second and fourth sides being equal in length;

wherein said second and fourth sides of each wall member are connected to an adjacent wall member by at least one approximately vertical fold line;

(b) a plurality of roof members each having an erect and a collapsed orientation, each roof member including a plurality of sides including at least a first side and a second side;

wherein said roof members include at least a side roof member and an end roof member;

wherein the first sides of each roof member are equal in length and the first and second sides of each side roof member are equal in length;

wherein said first side of each wall member is connected to said first side of each corresponding roof member by an approximately horizontal fold line;

wherein at least two roof members include a connecting means of joining roof members;

wherein, said roof members are adapted to fold outward and down to rest against corresponding wall members in the collapsed state;

wherein the play structure is collapsible by urging a set of opposed vertical fold lines inward so that a set of adjacent wall panels are urged to a substantially co-planar relationship over an approximately equal set of adjacent wall panels urged to a substantially co-planar relationship so that all wall panels are adapted to form a flat configuration;

wherein said flat configuration is foldable approximately in half at the vertical fold lines located in an approximate middle of the flat configuration so that all wall panels and associated roof panels are urged into a single stack, one panel on top of another;

whereby said single stack is approximately a same length and height of one said wall panel; and whereby the wall members and the associated roof members in the erect state form a rigid, stationary structure.

2. The collapsible play structure of claim 1 wherein the wall members and the associated roof members in the erect state are held together to form an enclosed interior space with said third side of each wall member adapted to rest on a surface to support said play structure;

wherein said enclosed interior space formed by said wall members is approximately a square.

3. The collapsible play structure of claim 1 wherein said second and fourth sides of each wall member are connected by said approximately vertical fold lines selected from a group consisting of one vertical fold line and more than one vertical fold line.

4. The collapsible play structure of claim 1 in the erect orientation wherein (a) a third side of each side roof panel rests upon a third side of an adjacent end roof panel; and (b) a fourth side of each side roof panel rests upon the second side of another adjacent end roof panel.

5. The collapsible play structure of claim 4 wherein the second side and the third side of said end roof panel further include an intermediate protruding tab and the third side and the fourth side of said side roof panel further include an intermediate mating slot.

6. The collapsible play structure of claim 1 wherein the side roof members further include a means for locking the side roof members to each other.

7. The collapsible play structure of claim 6 wherein the locking means is formed of interlocking tabs integral to the roof panels, whereby the side roofs form a stable roof configuration.

8. The collapsible play structure of claim 1 wherein said roof panels form either roof selected from the group consisting of gable-shaped roofs and gambrel-shaped roofs;

wherein a gambrel-shaped roof is formed when said side roof panels comprise an intermediate fold line approximately parallel and approximately equal in length to the first and second sides of said side roof panels, and said end roof panels comprise two slopes on said second side and a third side with a lower slope steeper than an upper slope.

9. The collapsible play structure of claim 1 wherein said side wall members, and said end wall members are approximately proportional to each other.

10. The collapsible play structure of claim 1 wherein said play structure is approximately symmetrical.

11. The collapsible play structure of claim 1 wherein said wall members are comprised of a predetermined shape and said roof members are comprised of a predetermined shape to form a predetermined pitch of the roof.

12. The collapsible play structure of claim 1 wherein said play structure is a continuous piece of foldable material.

13. The collapsible play structure of claim 1 wherein at least one of said wall members further includes at least one opening.

14. The collapsible play structure of claim 1 wherein said play structure comprises a design complementing its artwork.

15. The collapsible play structure of claim 1 wherein the structure comprises four of said wall members and four of said roof members, each roof member being integrally connected to each wall member at a fold line, thereby allowing firstly the four roof members to be folded outward and down to rest upon corresponding wall members and secondly two wall members to rest on top of two other wall members in a flat configuration and thirdly the flat configuration to be folded in half so that all four wall members lay on top of one another in said single stack.

16. The collapsible play structure of claim 1 wherein a connecting means of joining wall members is further included on the sides of wall members selected from a group consisting of the fourth sides of two opposed wall members, the second sides of two opposed wall members, the fourth side of one wall member, and the second side of one wall member.

17. The collapsible play structure of claim 1 wherein said side roof members are approximately equal in size to said wall members.

18. A method for collapsing and erecting a structure comprised of a plurality of wall panels approximately equal in size, a connecting means for joining said wall panels, end roof panels, and side roof panels comprising the steps of:

(a) releasing a means for locking said side roof panels;

(b) opening said side roof panels such that said side roof panels rest upon said wall panels;

(c) opening said end roof panels so that said end roof panels rest upon said wall panels;

(d) urging inward one of the connecting means such that it is contiguous with an opposite connecting means to form a flat configuration;

(e) folding said flat configuration approximately in half by bringing together other opposite connecting means such that they are contiguous;

whereby a compact unit approximately the size of one wall member is formed ready for storage;

whereby a person can store the structure in a convenient location; and whereby a person can erect and collapse the structure with ease.

19. The method of claim 1 wherein the connecting means is comprised of at least one fold line.

20. A play structure having an erect state and a collapsed state, comprised of:

(a) a plurality of wall members of approximately equal size, each hingedly attached to a different one of said wall members to form a corner;

(b) a pair of opposed side roof members extending upwardly from and hingedly attached to the respective wall members;

wherein said side roof members are contiguous when in said erect state;

(c) releasable integral interlocking tabs associated with the tops of said side roof members to interconnect the same to provide said play structure with stability in said erect state;

(d) a pair of opposed end roof members extending upwardly from and hingedly attached to the respective wall members;

wherein one of said side roof members overlaps a portion of one of said end roof members when said play structure is in said erect state;

(e) releasable intermediate tabs and slots associated with said end roof members and said side roof members to interconnect the same to provide said play structure with stability in said erect state;

wherein the roof members are foldable outward to rest upon the corresponding wall member and said wall members are collapsible upon each other by pushing inward a corner of the erect play structure such that said corner is approximately contiguous with an opposite corner to form a flat configuration, and by folding said flat configuration approximately in half by bringing together a folded outer corner to an opposite folded outer corner such that the outer comers are contiguous;

whereby said play structure forms a compact, storable unit in said collapsed state.

21. The play structure of claim 20 wherein said wall members are hingedly attached to each other by at least one fold line and the roof members are hingedly attached to said respective wall members by at least one fold line.

* * * * *